US005549447A

United States Patent [19]

Bevington

[11] Patent Number: 5,549,447

[45] Date of Patent: Aug. 27, 1996

[54] SYSTEM FOR COOLING A CENTRIFUGAL PUMP

[75] Inventor: Jack T. Bevington, Ashland, Ohio

[73] Assignee: McNeil (Ohio) Corporation, St. Paul, Minn.

[21] Appl. No.: 517,341

[22] Filed: Aug. 21, 1995

[51] Int. Cl.[6] ..... F04D 13/08; F04D 29/58

[52] U.S. Cl. ..... 415/115; 415/180; 417/371; 417/423.3; 417/423.8; 417/424.1

[58] Field of Search ..... 417/371, 423.3, 417/423.8, 424.1; 415/115, 116, 117, 180

[56] References Cited

U.S. PATENT DOCUMENTS

| | | | |
|---|---|---|---|
| 2,939,400 | 6/1960 | Maynard | 417/423.3 |
| 3,494,291 | 2/1970 | Carter, Jr. | 417/371 |
| 3,667,870 | 6/1972 | Yashida et al. | 417/371 |
| 4,465,437 | 8/1984 | Jensen et al. . | |
| 4,475,873 | 10/1984 | Jensen et al. . | |
| 4,484,862 | 11/1984 | Jensen . | |
| 4,773,822 | 9/1988 | Jensen et al. . | |
| 4,930,996 | 6/1990 | Jensen et al. . | |
| 4,981,420 | 1/1991 | Jensen et al. . | |
| 5,028,218 | 7/1991 | Jensen et al. . | |
| 5,332,369 | 7/1994 | Jensen . | |

FOREIGN PATENT DOCUMENTS

| | | | |
|---|---|---|---|
| 0013196 | 1/1983 | Japan | 415/116 |

*Primary Examiner*—Edward K. Look
*Assistant Examiner*—Christopher Verdier
*Attorney, Agent, or Firm*—Renner, Kenner, Greive, Bobak, Taylor & Weber

[57] ABSTRACT

A submersible pump (10) includes a casing (11) which houses a motor (13) and a pump assembly (14). A shaft (12) which carries the impeller (37) portion of the pump assembly (14) is driven by the motor (13) to draw fluid, in which the pump (10) is immersed, into the casing (11) through inlet ports (38) to be transferred to the pump assembly (14) and thereby pumped to a remote location. The shaft (12) has an axial bore (40) therein which is open at the bottom (41) to receive fluid. That fluid moves upwardly within the shaft (12) and passes out through radial bores (43) to join with the fluid received from the inlet ports (38). As such, internal fluid positioned in a chamber (23) is cooled by the fluid passing through the shaft (12) and that internal fluid in turn maintains the components in the casing (11) cool.

15 Claims, 1 Drawing Sheet

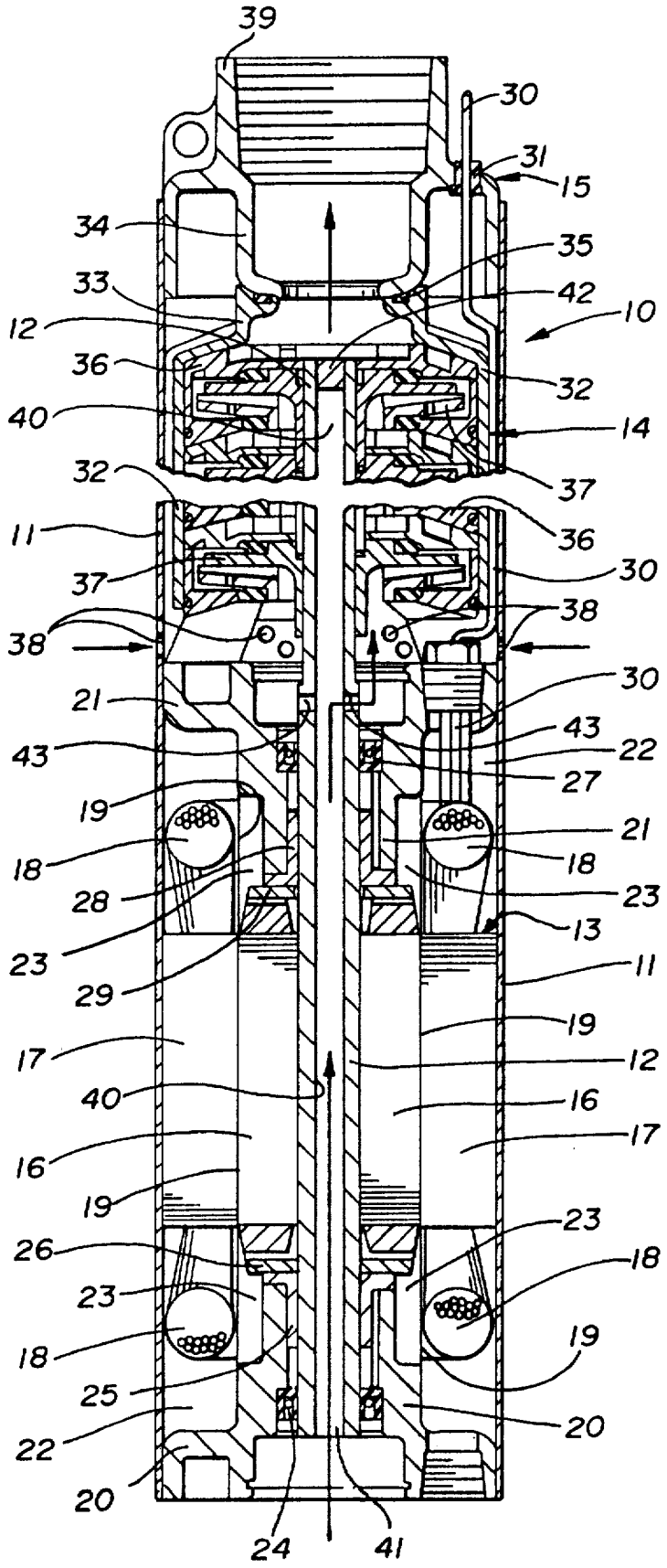
39
30
31
15
34
35
33
42
12
10
36
32
40
14
32
37
11
36
37
30
38
38
30
21
43
43
22
27
19
21
18
18
28
23
23
13
29
11
19
17
12
40
16
16
17
19
23
26
18
23
18
19
25
20
22
20
24
41

SYSTEM FOR COOLING A CENTRIFUGAL PUMP

TECHNICAL FIELD

This invention relates to centrifugal pumps of the type, for example, that transfer water from a well to a domestic or commercial establishment. More particularly, this invention relates to a system for cooling the motor and other components of such a pump and is particularly suited for a high speed pump.

BACKGROUND ART

Submersible pumps which have a motor-driven shaft that carries pump components are well known in the art. A prevalent problem with such pumps, however, is the overheating and failure of the internal motor and bearing components.

At one time, such components were immersed in an oil bath which was generally adequate to maintain the components cool enough to avoid failure while pumping water from a well to a remote location. However, with such oil-filled pumps, there is always the environmental and safety hazard of oil leaking into the well water.

As a result, more recently, internally confined water has replaced oil as the more standard cooling medium for submersible pumps. However, while such solves any environmental or safety problems, because the heat capacity of water is less than that of oil, the cooling efficiency of water-cooled pumps is far lower than that of oil-cooled pumps. Moreover, when water-cooled submersible pumps are operated at high speeds on a fairly continuous basis, the internal water churns so fast that, and is heated to the extent that, it may actually boil and turn to steam which, in turn, eliminates the hydrodynamic motor bearing film causing system failure.

In an effort to cool the internal water, some attempts have been made to circulate that water in the annulus between a hollow tube positioned in a hollow drive shaft. The warm water is pumped up in the annulus and is thereby exposed, near the top thereof, to the cooler well water. The circulating internal water then moves down the tube and back to the area of the hot motor. This elaborate system, while dissipating some heat, does not totally solve the problem and is not cost-effective.

DISCLOSURE OF THE INVENTION

It is thus an object of the present invention to provide a method and apparatus for cooling a centrifugal pump.

It is another object of the present invention to provide a method and apparatus, as above, wherein the cooling medium is internal water.

It is a further object of the present invention to provide a method and apparatus, as above, which utilizes the water being pumped as the means to maintain the internal water cool.

It is a still further object of the present invention to provide a method and apparatus, as above, which permits movement of the water being pumped up through the shaft of the pump and to the pump outlet while at the same time cooling the surrounding internal water.

These and other objects of the present invention, as well as the advantages thereof over existing prior art forms, which will become apparent from the description to follow, are accomplished by the improvements hereinafter described and claimed.

In general, a pump which is adapted to be submersed in the fluid which is to be pumped to a remote location includes a casing which houses a motor and a pump assembly. A shaft is driven by the motor and carries a portion of the pump assembly. Fluid enters the casing through inlets and is thereafter transferred to the remote location by the pump assembly. The shaft is provided with an axial bore which receives the fluid at one end thereof, the fluid passing through the shaft to cool the components inside the casing.

A preferred exemplary submersible pump incorporating the concepts of the present invention is shown by way of example in the accompanying drawing without attempting to show all the various forms and modifications in which the invention might be embodied, the invention being measured by the appended claims and not by the details of the specification.

BRIEF DESCRIPTION OF THE DRAWINGS

The drawing FIGURE is a fragmented, longitudinal sectional view of a submersible pump made in accordance with the concepts of the present invention.

PREFERRED EMBODIMENT FOR CARRYING OUT THE INVENTION

A pump made in accordance with the concepts of the present invention is indicated generally by the numeral 10 and is adapted to be submersed in a fluid, for example, water in a well, to move water from the well to a remote location. Pump 10 includes an outer cylindrical casing 11 which houses a longitudinally extending, axial shaft 12 rotatedly driven by a motor assembly generally indicated by the numeral 13. Pump 10 also includes a pump assembly positioned near the upper end of shaft 12 and generally indicated by the numeral 14 which moves the well water through a discharge bowl generally indicated by the numeral 15 to the remote location.

Motor assembly 13 includes a conventional rotor 16, which rotatably drives shaft 12, and a stator 17 having windings 18. Stator 17 is isolated from rotor 16 by a thin, cylindrical inner liner 19 spaced from and concentric with casing 11. Motor assembly 13 is closed at its lower end by a conventional bearing housing 20 and at its upper end by an essentially identical bearing housing 21. The annulus 22 formed between liner 19 and casing 11, and axially closed by housings 20 and 21, which annulus 22 confines stator 17 and its windings 18, is preferably filled with an epoxy material. Also, as will hereinafter be discussed in more detail, the area 23 or chamber formed within liner 19, is also axially closed by housings 20 and 21, and is filled with internal cooling water or other fluid.

Motor assembly 13 also includes a conventional lower shaft seal 24 between housing 20 and shaft 12, lower shaft bearings 25, and a lower thrust washer 26. Similarly, an upper shaft seal 27 is provided between housing 21 and shaft 12, and upper shaft bearings 28 and an upper thrust washer 29 are also provided, all of which are conventional items. Motor assembly 13 is provided with its electrical power via a power cord 30 which extends from a power source at a remote location, through a grommet 31 in a wall of discharge bowl 15, and then within casing 11 to motor windings 18.

Pump assembly 14 includes a cartridge housing 32 having an upper lip 33 which is sealed against the lower end 34 of discharge bowl 15, as by O-ring 35. Cartridge 32 carries a plurality of conventional stationary diffusers 36 which axially alternate with a like plurality of conventional impellers 37 which are carried by and rotate with shaft 12. Each impeller/diffuser combination forms a pump stage, and pump 10 may be provided with any number of pump stages dependent on the pump size requirements for a particular application.

Water from the well or other source in which pump 10 may be submersed passes through casing 11 at a fluid inlet area located between motor assembly 13 and pump assembly 14. Thus, as shown, a plurality of inlet openings 38 may be provided circumferentially around casing 11. Upon rotation of shaft 12 by motor assembly 13, pump assembly 14 will draw water radially inwardly through openings 38 and the impeller/diffuser stages will pump the water axially upwardly through the lower end 34 of discharge bowl 15. The upper end 35 of discharge bowl 15 can be connected to a discharge conduit which transfers the water to a remote location.

As pump 10 so operates, a great deal of heat is built up on the inside of casing 11, particularly at the area of motor assembly 13. The fluid in confined area 23 is intended to maintain the motor components, including bearings 25 and 28, at a tolerable temperature. However, at high speeds and over rather continual periods of use, this cooling fluid may not alone be able to dissipate the heat generated by the motor rotating the shaft.

To solve this problem, in accordance with the present invention, shaft 12 is provided with an axial bore 40 which is open at its bottom end 41 and preferably closed at its top end 42. The bottom end 41 of bore 40 is thus generally coincident with the bottom of bearing housing 20 and is exposed to the water in the well or other area in which pump 10 is submerged. This water is, of course, typically much cooler than any of the pump components and cooler than the fluid confined in area 23. Shaft 12 is also provided with a plurality of bores 43 extending radially therethrough at an axial location generally adjacent to the fluid inlet area, that is, axially near inlet openings 38. Thus, axial bore 40 communicates with the fluid inlet area through radial bores 43.

Upon the operation of pump 10, not only is external water drawn in through inlet openings 38, but also due to the centrifugal force, the suction of pump assembly 14, and the fact that warmer water will rise, external water is drawn in through the bottom end 41 of bore 40 and passes out through the radial bores 43 where it mixes with the water in the fluid inlet area and passes through pump assembly 14. As such, this circulation of continually new, fresh, cool water, cools shaft 12 and its surrounding elements, including the internal water in area 23. It should also be appreciated that the system would also operate to circulate cool well water if shaft 12 were not closed at its top end 42 and if radial bores 43 were eliminated. In this instance, the flow would reverse, that is, well water would flow through shaft 12 from top to bottom. The water would be received through inlet openings 38, moved through pump assembly 14 to the top of shaft 12, and then transferred through shaft 12 and out bottom opening 41. In either event, the internal water is maintained substantially cooler than previously heretofore known thereby maintaining bearings 25 and 28 as well as the other components of motor assembly 13 more safely cool.

In fact, actual testing has demonstrated the dramatic effect of the system of the present invention. For example, a prior art pump was run at maximum amperage and at 10,000 RPMS and the temperature of the internal fluid was measured at one hour intervals. The following data was observed:

| Elapsed Time | Temperature |
|---|---|
| Start-Up | 86° F. |
| 1 Hour | 120° F. |
| 2 Hours | 220° F. |
| 3 Hours | 250° F. |
| 3 Hours, 5 minutes | Pump Failure |

Running the same test for pump 10 of the present invention resulted in the following observed temperatures of the fluid in area 23:

| Elapsed Time | Temperature |
|---|---|
| Start-Up | 86° F. |
| 1 Hour | 110° F. |
| 2 Hours | 120° F. |
| 3 Hours | 126° F. |
| 4 Hours | 130° F. |
| 5 Hours | 127° F. |
| 6 Hours | 131° F. |
| 16 Hours | 130° F. |
| 17 Hours | 127° F. |
| Test Terminated | |

It can readily be seen that the fluid temperature for the pump of the present invention stabilized at a temperature approximately 120° F. less than the maximum temperature observed just prior to failure of the prior art pump. It should thus be apparent that a pump made in accordance with the concepts of the present invention accomplishes the objects of the invention and otherwise substantially improves the submersible pump art.

What is claimed is:

1. Apparatus adapted to be submersed in a fluid and to pump the fluid to a remote location comprising a casing, a motor within said casing, a pump assembly within said casing, a shaft driven by said motor and carrying a portion of said pump assembly, and an inlet to permit some fluid to enter the casing to be thereafter transferred from a pump inlet area by said pump assembly to the remote location, said shaft having an axial bore therein adapted, at one end thereof, to receive some fluid therein, that fluid moving in said axial bore to cool the inside of said casing, said shaft also having radial bores communicating with said axial bore and being positioned generally adjacent to said pump inlet area so that the fluid moving in said axial bore may pass through said radial bores and join with the fluid entering the casing.

2. Apparatus according to claim 1 wherein said one end of said axial bore is open and exposed to the fluid.

3. Apparatus according to claim 2 wherein the other end of said axial bore is closed.

4. Apparatus according to claim 1 further comprising a chamber formed in said casing, and a liquid in said chamber, the fluid in said axial bore cooling said liquid.

5. Apparatus according to claim 1 wherein said inlet is in the form of openings in said casing.

6. Apparatus according to claim 1 wherein said pump assembly includes at least one diffuser carried in said casing and said portion of said pump assembly carried by said shaft includes at least one impeller positioned axially adjacent to said one diffuser.

7. Apparatus according to claim 6 further comprising a pump discharge area axially adjacent to the last of said diffusers.

8. Apparatus according to claim 6 wherein said pump inlet area is axially adjacent to the first of said impellers.

9. Apparatus adapted to be submersed in a fluid and to pump the fluid to a remote location comprising a casing, a motor within said casing, a pump assembly within said casing, said pump assembly including at least one diffuser carried in said casing and at least one impeller positioned axially adjacent to said at least one diffuser, a shaft driven by said motor and carrying said at least one impeller, an inlet to permit some fluid to enter the casing to be thereafter transferred from a position axially adjacent to the first of said impellers by said pump assembly to the remote location, said shaft having an axial bore therein adapted, at one end thereof, to receive some fluid therein, that fluid moving in said axial bore to cool the inside of said casing, said shaft also having radial bores communicating with said axial bore so that the fluid moving in said axial bore may pass through said radial bores at the position axially adjacent to the first of said impellers.

10. A method of utilizing a pump to transfer a fluid to a remote location while cooling the internal portions of the pump submersed in the fluid, the pump having a motor driven shaft and a pump assembly having an inlet side and an outlet side, comprising the steps of introducing some fluid through an inlet to the inlet side of the causing some fluid to flow through an axial bore in the shaft thereby cooling the internal portions of the pump, discharging the fluid from the axial bore through radial bores positioned generally adjacent to the inlet side of the pump to mix with the fluid introduced through the inlet, and moving the fluid from the inlet side to the outlet side of the pump assembly for axial discharge to the remote location.

11. A method according to claim 10 further comprising the step of exposing one end of the axial bore to the fluid so that the fluid may be introduced into the axial bore through the one end.

12. A method according to claim 11 further comprising the step of closing the other end of the axial bore.

13. A method according to claim 10 further comprising the step of positioning a liquid in a chamber in the pump such that it will be cooled by the fluid flowing through the axial bore and in turn cool the internal portions of the pump.

14. A method according to claim 10 wherein the step of causing is accomplished by rotating the shaft which carries the pump assembly.

15. Apparatus adapted to be submersed in a fluid and to pump the fluid to a remote location comprising a casing, a motor within said casing, a pump assembly within said casing, said pump assembly including at least one diffuser carried in said casing and at least one impeller positioned generally axially adjacent to said one diffuser, a shaft driven by said motor and carrying said at least one impeller, an inlet to permit some fluid to enter the casing and be positioned generally axially adjacent to the first of said impellers, a chamber formed in said casing, a liquid in said chamber, and a pump discharge area generally axially adjacent to the last of the said diffusers, said shaft having an axial bore therein adapted, at one end thereof, to receive some fluid therein, the fluid moving in said axial bore to cool the inside of said casing and said liquid in said chamber, such that upon rotation of said shaft by said motor, the fluid is transferred by said pump assembly through said pump discharge area to the remote location.

* * * * *

UNITED STATES PATENT AND TRADEMARK OFFICE

CERTIFICATE OF CORRECTION

PATENT NO. : 5,549,447

DATED : August 27, 1996

INVENTOR(S) : Bevington

It is certified that error appears in the above–identified patent and that said Letters Patent are hereby corrected as shown below:

Claim 10, column 5, line 25, before the word "causing" insert the word --pump,--.

Signed and Sealed this

Tenth Day of December, 1996

*Attest:*

*Attesting Officer*

BRUCE LEHMAN

*Commissioner of Patents and Trademarks*